US009782632B1

(12) United States Patent
Breaker

(10) Patent No.: US 9,782,632 B1
(45) Date of Patent: Oct. 10, 2017

(54) GOLF BALL

(71) Applicant: John V. Breaker, Golden, CO (US)

(72) Inventor: John V. Breaker, Golden, CO (US)

( * ) Notice: Subject to any disclaimer, the term of this patent is extended or adjusted under 35 U.S.C. 154(b) by 0 days.

(21) Appl. No.: 15/134,011

(22) Filed: Apr. 20, 2016

Related U.S. Application Data

(60) Provisional application No. 62/149,795, filed on Apr. 20, 2015.

(51) Int. Cl.
*A63B 37/00* (2006.01)

(52) U.S. Cl.
CPC ..... *A63B 37/0039* (2013.01); *A63B 37/0074* (2013.01)

(58) Field of Classification Search
CPC ..... A63B 37/0056; A63B 37/0098; A63B 39/003
USPC ..... 473/351–378
See application file for complete search history.

(56) References Cited

U.S. PATENT DOCUMENTS 790,954 A * 5/1905 Davis ..... A63B 37/0097 473/355
1,023,504 A * 4/1912 Chester ..... A63B 39/00 273/DIG. 15
1,255,388 A * 2/1918 Cobb ..... A63B 37/0097 473/355
1,483,165 A * 2/1924 Eaton ..... A63B 69/3655 473/281
1,572,527 A * 2/1926 Goldsworthy ..... A63B 69/3617 473/235
1,964,008 A * 6/1934 Roberts ..... A63B 39/00 267/35
2,211,330 A * 8/1940 Hochberg ..... A63F 7/0005 273/118 D
2,307,182 A * 1/1943 Young ..... A63B 37/0003 473/354
2,597,704 A * 5/1952 Carlson ..... B29C 65/20 156/245
2,705,148 A * 3/1955 Waller ..... A63B 59/30 124/5
2,953,922 A * 9/1960 Bonkowski ..... A63B 69/3655 473/200
2,975,823 A * 3/1961 Ponnock ..... B29C 65/04 156/245
3,908,994 A * 9/1975 Astrom ..... A63B 43/00 473/281

(Continued)

*Primary Examiner* — Alvin Hunter
(74) *Attorney, Agent, or Firm* — Perkins Coie LLP

(57) ABSTRACT

Golf ball with through-hole(s) incorporating hollow air pocket(s) to produce thinner outer wall facilitating more speed and responsiveness off of the golf club's face at impact is disclosed. A thin outer wall is desirable in golf ball design. A wall that is too thick inhibits rebound and promotes fracturing. A thinner wall with structural supports allows for the outer wall to be thinned while producing an internal structure that promotes rebound and not structural failure. This volume of material formed into the volume to help resist deformation of the outer shell. The internal structure between the outer shell and inner axial shaft can be a honeycomb-like pattern or concentric rings to create more structure, less air volume and faster response. These smaller compartments of air will create more rebound because of the additional force of the more responsive inner structure providing a spring effect as well.

20 Claims, 4 Drawing Sheets

(56) References Cited

U.S. PATENT DOCUMENTS

Figure 1:
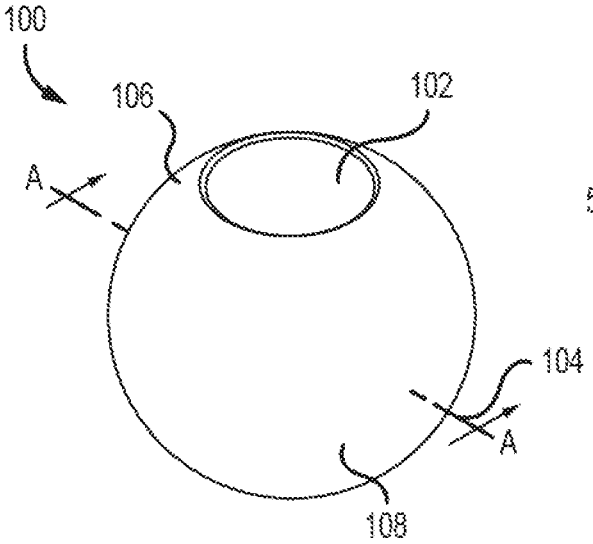

| | | | | | |
|---|---|---|---|---|---|
| 4,006,908 | A * | 2/1977 | Minami | A63B 39/00 | 273/DIG. 20 |
| 4,305,583 | A * | 12/1981 | Tandon | A63B 39/00 | 473/609 |
| 4,660,834 | A * | 4/1987 | Carrigan | A63B 69/3691 | 473/165 |
| 4,697,807 | A * | 10/1987 | Boundy | A63H 37/00 | 273/380 |
| 4,930,776 | A * | 6/1990 | Newcomb | A63B 43/06 | 273/DIG. 20 |
| 5,033,743 | A * | 7/1991 | Wright | A63B 43/00 | 273/DIG. 20 |
| 5,062,912 | A * | 11/1991 | Hoffman | A63B 39/00 | 156/145 |
| 6,012,997 | A * | 1/2000 | Mason | A63B 43/00 | 273/DIG. 20 |
| 6,045,454 | A * | 4/2000 | Chu | A63B 69/3655 | 473/280 |
| 6,773,363 | B2 * | 8/2004 | Sullivan | A63B 37/0097 | 473/355 |
| 7,300,357 | B2 * | 11/2007 | Breaker | A63B 43/002 | 273/DIG. 20 |
| 8,251,837 | B2 * | 8/2012 | Alan | A63B 37/0003 | 473/352 |
| 8,986,136 | B2 * | 3/2015 | Alan | A63B 37/0004 | 473/374 |
| 9,254,422 | B2 * | 2/2016 | Sullivan | A63B 37/0058 | |
| 9,457,237 | B2 * | 10/2016 | Alan | A63B 37/0005 | |
| 9,592,426 | B1 * | 3/2017 | DiPietro | A63B 39/00 | |

* cited by examiner

GOLF BALL

CROSS-REFERENCE TO RELATED PATENT APPLICATIONS

The present application claims priority under 35 U.S.C. §§119, 120 to U.S. Provisional Patent Application Ser. No. 62/149,795, filed Apr. 20, 2015, titled GOLF BALL WITH THROUGH HOLE(S) INCORPORATING HOLLOW AIR POCKET(S) TO PRODUCE THINNER OUTER WALL FACILITATING MORE SPEED AND RESPONSIVENESS OFF OF THE GOLF CLUB'S FACE AT IMPACT," the disclosure of which is incorporated herein as if set out in full.

BACKGROUND

While the origin of the game of golf is disputed, the modern game of golf is generally believed to have originated in Scotland several centuries ago. Since the dawn of the game, golfers have endeavored to hit a golf ball with more distance and more accuracy. The golf club has gone through numerous design chances to accomplish this feat. The golf ball also has gone through numerous changes to accomplish greater distance and accuracy. However, despite numerous changes, improvements to golf balls are desirous. Such improvements may, among other things, increase the energy imparted to the golf ball from the impact of the golf club with the golf ball.

SUMMARY

This Summary is provided to introduce a selection of concepts in a simplified form that are further described below in the Detailed Description. This Summary, and the foregoing Background, is not intended to identify key aspects or essential aspects of the claimed subject matter. Moreover, this Summary is not intended for use as an aid in determining the scope of the claimed subject matter.

In some aspects of the technology, a golf ball is provided. The golf ball comprises a sphere having a large through hole along a diameter of the sphere. The through hole defines an inner wall of the golf ball, generally forming a cylindrical shape through the center of the sphere. The golf ball further has one or more recesses formed between an outer wall of the sphere and the inner wall of the sphere. The one or more recesses may be considered pockets or voids filled with air, foam, or other polymer based, compressible materials. The outer wall is configured to elastically deform into the one or more recesses, which may compress the compressible material filling the pocket. Subsequent to impact, the compressible material facilitates rebounding of the outer wall, which aids in the transfer of force from the golf club to the golf ball and increases distance traveled among other things.

These and other aspects of the present system and method will be apparent after consideration of the Detailed Description and Figures herein.

DRAWINGS

Non-limiting and non-exhaustive embodiments of the present invention, including the preferred embodiment, are described with reference to the following figures, wherein like reference numerals refer to like parts throughout the various views unless otherwise specified.

FIG. 1 is a perspective view of a golf ball with a through hole consistent with the technology of the present application.

Figure 2A:
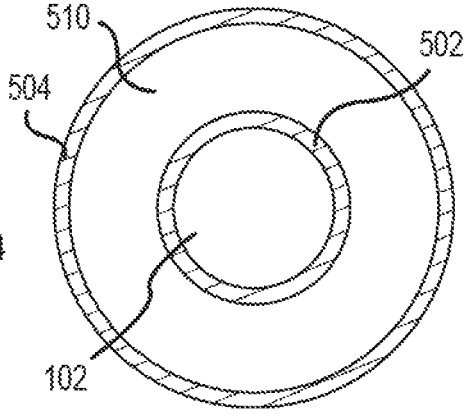
Figure 2B:
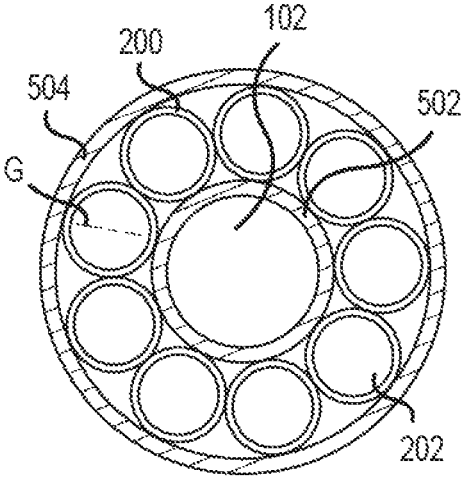
Figure 2C:
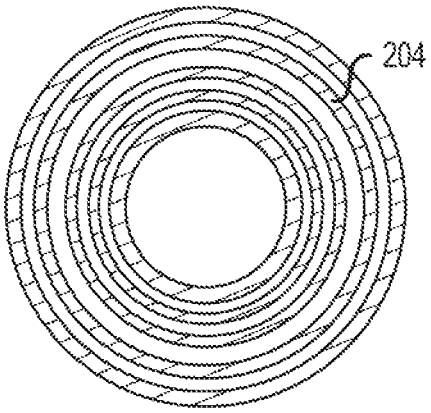

FIGS. 2*a*-2*c* are cross-sectional views of the golf balls of FIG. 1 along the diameter of golf ball perpendicular to the through hole consistent with the technology of the present application.

Figure 3A:
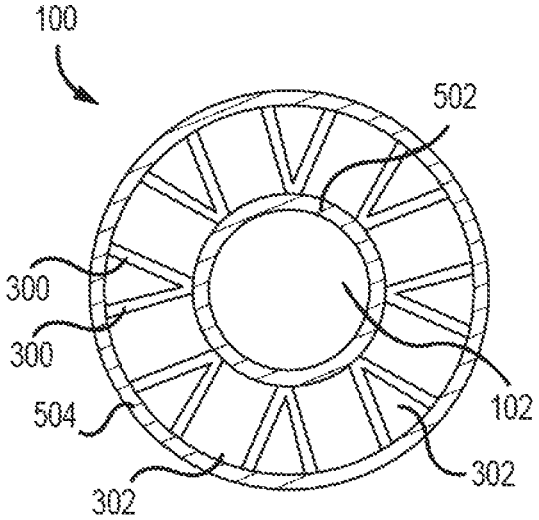
Figure 3B:
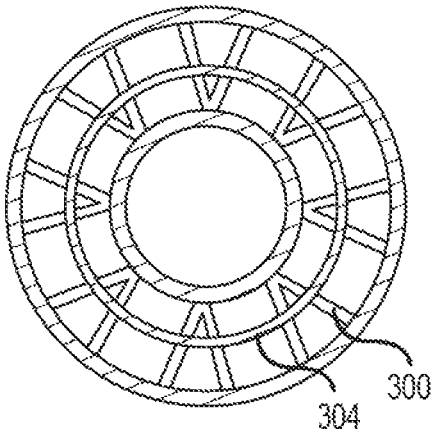
Figure 3C:
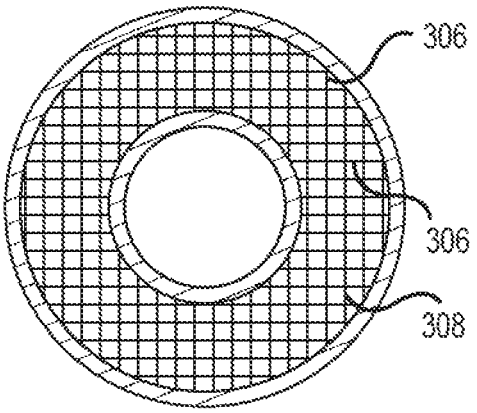

FIGS. 3*a*-3*c* are cross-sectional views of the golf balls of FIG. 1 along the diameter of golf ball perpendicular to the through hole consistent with the technology of the present application.

Figure 4A:
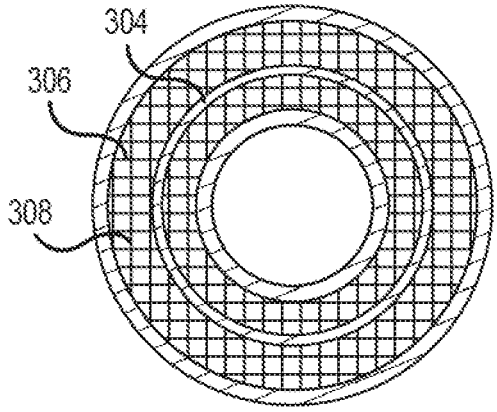
Figure 4B:
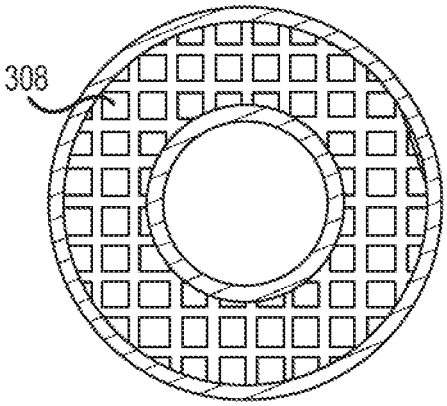
Figure 4C:
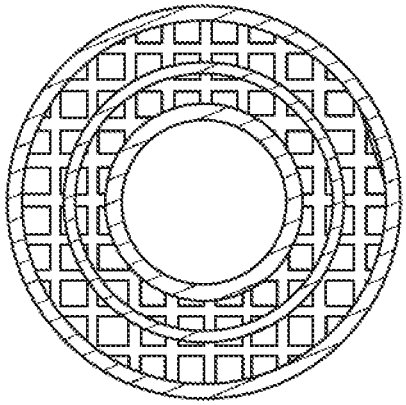

FIG. 4*a-c* are cross-sectional views of the golf balls of FIG. 1 along the diameter of golf ball perpendicular to the through hole consistent with the technology of the present application.

Figure 5A:
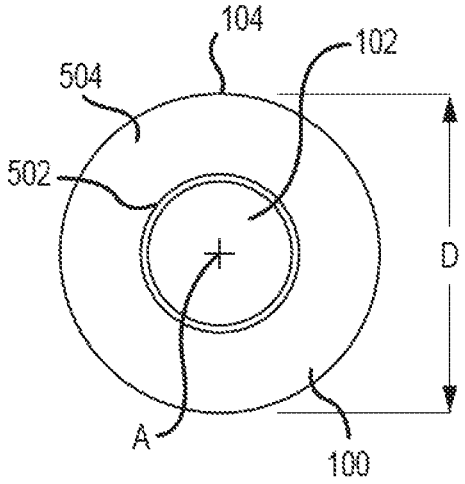
Figure 5B:
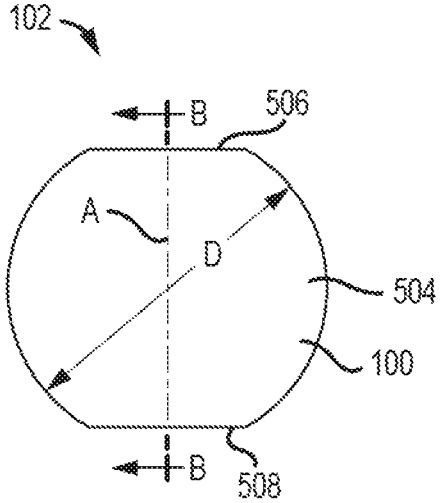
Figure 5C:
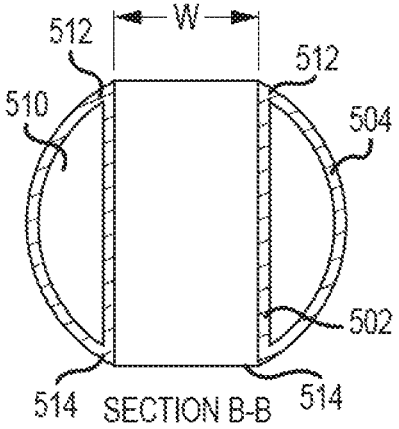

FIG. 5*a-c* are views of the exemplary golf ball of FIG. 1 consistent with the technology of the present application.

DETAILED DESCRIPTION

The technology of the present application will now be described more fully below with reference to the accompanying figures, which form a part hereof and show, by way of illustration, specific exemplary embodiments. These embodiments are disclosed in sufficient detail to enable those skilled in the art to practice the technology of the present application. However, embodiments may be implemented in many different forms and should not be construed as being limited to the embodiments set forth herein. The following detailed description is, therefore, not to be taken in a limiting sense.

The technology of the present application is described with specific reference to a generally sphere shaped golf ball. However, the technology described herein may be used for other sport balls where energy is imparted by contact such as, for example, a baseball and baseball bat combination, a football and football kick combination, or the like. Moreover, the technology of the present application will be described with relation to exemplary embodiments. The word "exemplary" is used herein to mean "serving as an example, instance, or illustration." Any embodiment described herein as "exemplary" is not necessarily to be construed as preferred or advantageous over other embodiments. Additionally, unless specifically identified otherwise, all embodiments described herein should be considered exemplary.

Golf balls with a straight through-hole running axially through a spherical shape create a large cross section at the equator of the golf ball. For a spherically shaped golf ball, the through hole creates a wall that expands to a large thick cross section at the center or middle of the golf ball that is subject to cracking during compression of the golf ball by the golf club at impact. Thinning this wall, by creating a cavity helps to prevent cracking of the outer wall and creates a more responsive outer wall. Further, by trapping a compressible material, such as air, between the inner wall formed by the through hole and the outer wall more energy is applied creating more rebound off of the golf club face, which should increase the overall distance of travel. By not having a gap between the outer wall and the axial through shaft the wall thickness creates a thick area that is less-responsive during golf club impact as the golf ball has less compression along the outer wall. A thin responsive outer wall is desirable in golf ball design. A wall that is too thick prevents rebound and promotes fracturing. A thinner wall, which may buttressed by hollow structural ribs, supports, and/or buttresses allows for the outer wall to be thinned while producing an internal structure that promotes rebound and not structural failure. The internal structure may have recesses, pockets, or voids that are filled with a compressible material, such as air, foam, or the like. This volume of, for example, trapped air can be compartmentalized into smaller compartments of trapped air to help resist deformation of the outer shell. For example, as the air in the recess is compressed, the internal pressure of the air in the recess increases to resist further deformation. The walls, ribs, and other supports, elastically deform and rebound. The increased pressure in the recess facilitates rebounding as the pressure is decreased by pushing the wall, rib, or other support back to its original position. The internal structure between the outer wall and inner wall, which is defined by the axial through hole can be a large void, a honeycomb-like pattern, ribs and beams, concentric rings, or the like to create more structure, less compressible material volume and faster response. These smaller compartments of air will create more rebound because of the additional force of the more responsive inner structure providing a spring effect as well.

As stated above, golf balls with a straight through-hole running axially through a spherical shape create a large cross section at the equator of the golf ball. The equator of the golf ball, as used herein, generally refers to the diameter of the golf ball perpendicular to the through hole. For example, as shown in FIG. 1, a golf ball 100 consistent with the technology of the present application is shown in a perspective view. The golf ball 100 is generally spherical in shape having a diameter. A through hole 102 is shown extending along a diameter of the golf ball. The equator 104 of the golf ball is the diameter of the golf ball formed at the plane interesting the through hole 102. FIGS. 2*a*-2*c*, 3*a*-3*c*, and 4*a*-4*c*, show cross-sectional views of the golf ball 100 along line A-A that corresponds to the equator 104 of the golf ball. The equator 104 generally is a plane that divides the golf ball into a top 1/2 106 and a bottom 1/2 108. Conventional golf balls, not golf ball 100, would have a large thick cross section at the equator 104 that is subject to cracking during compression of the golf ball by the golf club at impact. Thinning the material at the equator by creating a pocket or cavity, which may be filled with a compressible material such as air, helps to prevent cracking of the outer wall and creates an outer wall more responsive to the golf club. Further, by trapping a compressible material between the outer wall, or the inner surface of the outer wall and inner wall, or the outer surface of the internal axial through-hole may allow for better energy transfer between the golf club and the golf ball by creating more rebound off of the golf club face.

By creating gaps between an inner and outer wall of a golf ball, the outer wall can be thinner as compared to a conventional golf ball. Filling the gaps with compressible material, such as for example, air facilitates rebound because of the higher pressure helping the speed and force of the rebound of the golf ball off of the club face. The technology of the present application differs from, and is an improvement on, what currently exists. The existing golf ball with a through-hole does not work well as well because the wall thickens as the outer wall extends toward the equator of the sphere. By incorporating gap(s) between the outer wall and inner wall defined by the through-hole, the outer wall becomes thinner and the air (or other compressible material) trapped inside creates additional rebound force at impact with the golf club during the golf swing. A thin responsive outer wall is desirable in golf ball design. A wall that is too thick inhibits rebound and promotes fracturing. A thinner wall, buttressed by hollow structural ribs, supports, and/or buttresses, allows for the outer wall to be thinned while producing an internal structure that promotes rebound and not structural failure. This volume of trapped compressible material, such as, for example air or foam, can be compartmentalized into smaller compartments to resist deformation of the outer shell, which may help inhibit inelastic deformation as some elastic deformation is desirable for rebound. The internal structure between the outer wall and inner wall defined by the axial through hole can be a large void, a honeycomb-like pattern, ribs and/or beams, concentric rings, or the like to create more structure, less volume of compressible material and faster response. These smaller compartments tend to create more rebound because of the additional force of the more responsive inner structure providing a spring effect, as well.

With reference now to FIGS. 1 and 5*a*-*c*, an exemplary golf ball 100 consistent with the technology of the present application is provided. As shown in FIG. 1, the golf ball 100 has a through hole 102 along a diameter of the golf ball in an axial direction. An equator 104 extends along the diameter of the golf ball in a direction traverse to the axial direction of the through hole. The equator 104 generally divides the golf ball 100, consistent with the technology herein, into a top 1/2 106 and a bottom 1/2 108. Top and bottom are used for orientation of the golf ball 100 and the designation of top and bottom, left or right, and the like should not be considered limiting. With reference now to FIG. 5*a*, a top elevation view of the golf ball 100 is provided. The golf ball 100 has a through hole 102 extending along the diameter A of the golf ball 100. The golf ball has a diameter D along the equator 104 of 1.875 inches in this exemplary embodiment. Notice that the dimensions are provided for reference and are not limiting. The through hole 102 defines an inner wall 502 and the golf ball 100 has an outer wall 504.

FIG. 5*b* shows a side elevation view of the golf ball 100. The diameter A runs through the geometric center of the through hole 102 (not seen in FIG. 5*b*). The golf ball 100 is not a complete sphere as the top 1/2 106 and the bottom 1/2 108 each have a cut away portion 506, 508 due to the through hole 102. Thus, the length of the through hole 102 is slightly less than the diameter of the golf ball 100 at the equator 104. As shown in this exemplary embodiment, the through hole is 1.66 inches in length while the diameter of the golf ball along the equator is 1.875 inches, which information is provided for illustration purposes and should not be considered limiting.

FIG. 5*c* shows a cross sectional view of golf ball 100 taken along line B-B of FIG. 5*b*. The golf ball 100 has the through hole 102, which is generally a cylindrical shape through the golf ball 100 where the cylinder in this exemplary embodiment has a width W of 0.872 inches. The outer wall 504 and the inner wall 502 are shown in cross section as forming a recess or pocket 510 (shown better in FIG. 2*a*). The inner wall 502 and the outer wall 504 join at a top edge 512 and a bottom edge 514.

With reference now to FIGS. 2*a*-2*c*, cross sections of the golf ball 100 are provided. As shown in FIG. 2*a*, the golf ball may be provided with a single pocket 510 between the inner wall 502 and the outer wall 504. FIG. 2*b* shows an alternative construction where internal tubular members 200 are formed between the inner wall 502 and the outer wall 504 forming a plurality of pockets 202. The diameter of the tubular members 200 would be defined by the gap G between the inner wall 502 and outer wall 504, which may be variable. For example the gap may be less at the top and bottom of the golf ball 100 than at the equator. FIG. 2*c* shows still another embodiment of the golf ball 100 where there are a number of ribs 204 extending from the top to the bottom of the golf ball forming concentric circular rings along the cross section of the golf ball.

FIGS. 3*a*-3*c* shows still another internal structure for golf ball 100. FIG. 3*a* shows the golf ball 100 having the inner wall 502 and the outer wall 504 with a number of radially extending supports 300, such as, for example, walls, ribs, or buttresses, extending from the inner wall 502 to the outer wall 504. The supports 300 form a number of recesses 302. FIG. 3*b* is similar to the golf ball 100 shown in FIG. 3*a*, but includes a concentric ring support 304 in additional to the radially extending supports 300. While only one concentric ring support 304 is shown in FIG. 3*b*, multiple concentric ring supports 304 are possible. FIG. 3*c* shows yet another support structure internal to the golf ball between inner wall 502 and outer wall 504. In this exemplary embodiment, the supports are a plurality of walls 306 forming a honey-comb pattern 308. FIGS. 4*a*-4*b* show alternative versions of the honey-comb pattern 308. In particular, FIG. 4*a* shows the honey-comb patter 306, with the plurality of walls 306 may be formed with additional supports such as the concentric ring supports 304. FIG. 4*b* demonstrates that the honey-comb pattern 308 may be more or less fine as desired. FIG. 4*c* shows that the concentric ring supports may be used with different density honey-comb patterns. These and other support structures are possible. In certain aspects, the recesses, pockets, or voids formed by the technology of the present application may be filled with air. In other aspects, the recesses, pockets, or voids formed by the technology of the present application may be filled with foams, such as, for example, polyurethane foam, polystyrene foam, polyethylene, and the like.

While described in several embodiments above, in certain aspects, the technology of the present application includes a golf ball having a spherical shape with through-hole that bisects spherical shape and creates a straight surface on the poles of the sphere, which poles are defined by the through hole. An area between inner wall, or the outer surface of the through-hole and the outer wall, or inner surface of sphere creates open space that can be filled with a compressible material such as air, foam, or the like. The area between the inner wall and the outer wall can include structural shapes to aid in adding weight and providing additional rebound energy off of the club face. The air, foam, or other compressible material in the area formed between the inner wall and the outer wall create additional energy transfer by compressing and increasing in pressure.

In practice, when a golf club strikes a golf ball, the optimal strike is below the equator of the golf ball. This is true of the practice golf ball with the through-hole as described above. The golf club deforms the golf ball and the practice golf ball with the through-hole into a more oval shape (as opposed to the spherical shape). This ovality is exaggerated below the equator throwing the golf ball when it is rebounding into a high rate of reverse spin. The improved golf ball with a recess between an inner and outer wall behaves similarly. The practice golf ball with through-hole has a low threshold for this force and a corresponding lower push back, or rebound, off of the club face. The hollow area between the through-hole outer wall and the spherical inner wall has a certain volume of trapped air in most cases, foams in others, and still other compressible material in certain embodiments. This trapped material is locked in during the molding process or construction process. The material is trapped at ambient pressure at the time of production or it can be compressed to a higher pressure, such as compressed air. Regardless, when the improved golf ball with through-hole is compressed, the volume of air is reduced, which compresses the air and creates a higher pressure. T faster rebound off of the golf club face.

The technology of the present application constructed using 3D Printing or Injection Molding. One satisfactory material for manufacture is molded plastic or rubber. Injection molding is one satisfactory method for making the technology of the present invention, although compression molding can also be used. A plastic resilient to fracturing upon impact with a golf club will be utilized. Plastics which work include, but are not limited to: Polyethylene, Hi-Density Polyethylene and Ultra High Molecular Weight Polyethylene, Polyester, Polyester Elastomer, EVA, Nylon, ABS and PVC. The internal hollow area between the through-hole and spherical inside may be challenging to mold depending on the design. Creating this void is difficult in a single shot. Most likely, the production of this part is created by making two identical half spheres and welding them together. Plastic can be welded electrosonically or thermally. The pieces would be processed to be as air tight as possible. A hole in the improved golf ball allowing for pressure balancing between the inside of the golf ball and the outside pressure is not critical but may be accomplished. The air pressure increase on the inside of the golf ball during impact with the golf club will happen faster than the increased air pressure can be released allowing for the functionality of the golf ball even when pressure balanced before impact. Further, by making smaller structural compartments, the air will be trapped in smaller volumes thus making the pressure trap at impact more robust. The structure of the smaller compartment will also add to the rebound force off of the club head. The hollow area between the outside diameter of the through-hole shaft and the inner wall of sphere is necessary. Breaking this hollow area into smaller compartments provides additional rebound, durability, weight and mass. The hollow area can be filled structurally with many high strength shapes. Polygons, linear beams and circular hoop shapes can be used internally to strengthen the internal structure of the improved golf ball.

Modern golf balls have a high rebound core. Modern rebounding plastics and elastomers make the golf ball travel farther that the golf course was designed to handle. Further, water shortages in high population metropolitan areas create pressure to reduce the amount of water that can be used for a golf course. This, along with the reduction in leisure time of working people, makes it important to design an improved golf-ball-like device that can be used on smaller golf courses that require less water and time to play. Reducing the flight of the golf ball can be accomplished with a through-hole down the middle. This short distance can be actually too short. In order to make a more playable golf-ball-like device that can be used as a legitimate alternative to the golf ball requires creating an improved golf ball with higher rebound, compression, feel and moderate distance. Additionally, the improved "golf" ball can be used in any sport requiring a striking device. Hockey, baseball, lacrosse, field hockey and cricket are examples of games using round or cylindrical balls or ball-like objects like a puck. These devices can also utilize a through-hole and hollow internal structure to create additional rebound off the club.

Although the technology has been described in language that is specific to certain structures and materials, it is to be understood that the invention defined in the appended claims is not necessarily limited to the specific structures and materials described. Rather, the specific aspects are described as forms of implementing the claimed invention. Because many embodiments of the invention can be practiced without departing from the spirit and scope of the invention, the invention resides in the claims hereinafter appended. Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques. Moreover, all ranges disclosed herein are to be understood to encompass and provide support for claims that recite any and all subranges or any and all individual values subsumed therein. For example, a stated range of 1 to 10 should be considered to include and provide support for claims that recite any and all subranges or individual values that are between and/or inclusive of the minimum value of 1 and the maximum value of 10; that is, all subranges beginning with a minimum value of 1 or more and ending with a maximum value of 10 or less (e.g., 5.5 to 10, 2.34 to 3.56, and so forth) or any values from 1 to 10 (e.g., 3, 5.8, 9.9994, and so forth).

What is claimed is:

1. A golf ball comprising, an outer wall defining a generally spherical shape, the shape having a top and a bottom;

an inner wall coupled to the outer wall, the inner wall defining a through hole extending from the top to the bottom wherein the inner wall and the outer wall define at least one pocket; and a compressible material filling the at least one pocket between the inner wall and the outer wall.

2. The apparatus of claim 1 further comprising at least one support between the inner wall and the outer wall and wherein the at least one pocket comprises a plurality of pockets.

3. The apparatus of claim 2 wherein the at least one support comprises at least one concentric ring.

4. The apparatus of claim 3 wherein the at least one concentric ring comprises a plurality of concentric rings.

5. The apparatus of claim 2 wherein the at least one support comprises a plurality of radially extending walls.

6. The apparatus of claim 5 wherein the at least one support further comprises at least one concentric ring.

7. The apparatus of claim 2 wherein the at least one support comprises a plurality of walls forming a plurality of honey-combs.

8. The apparatus of claim 7 wherein further comprising at least one concentric ring.

9. The apparatus of claim 1 wherein the compressible material comprises air.

10. The apparatus of claim 1 wherein the compressible material comprises foam.

11. The apparatus of claim 10 wherein the foam is selected from the group of foams consisting of: polyurethane, polystyrene, polyethylene, or a combination thereof.

12. A golf ball comprising, an outer wall defining a generally spherical shape, the shape having a top surface and a bottom surface;

a through hole extending from the top surface to the bottom surface wherein the through hole is formed by an inner wall coupled to the outer wall;

at least one support wall forming a spherically shaped wall between the outer wall and the inner wall forming a plurality of cavities wherein one cavity is between the inner wall and the at least one support wall and another cavity is between the at least one support wall and the outer wall; and a compressible material filling the plurality of cavities.

13. The golf ball of claim 12 wherein the compressible material is air.

14. The golf ball of claim 12 wherein the compressible material is foam.

15. The golf ball of claim 14 wherein the foam is selected from the group of foams consisting of: polyurethane, polystyrene, polyethylene, or a combination thereof.

16. The golf ball of claim 12 wherein the at least one support wall comprises a plurality of radially extending walls.

17. A golf ball comprising, an outer wall defining a generally spherical shape, the shape having a top surface and a bottom surface;

an inner wall defining a through hole extending from the top surface to the bottom surface;

a plurality of intersecting support walls formed between the outer wall and the inner wall where the plurality of intersecting support walls form a plurality of pockets in a honey-comb pattern; and a compressible material filling the plurality of pockets.

18. The golf ball of claim 17 further comprising at least one spherically shaped wall between the inner wall and the outer wall.

19. The golf ball of claim 17 wherein the compressible material comprises a foam.

20. The golf ball of claim 19 wherein the foam is selected from the group of foams consisting of: polyurethane, polystyrene, polyethylene, or a combination thereof.

* * * * *